US010088176B2

(12) United States Patent
Ikeda et al.

(10) Patent No.: US 10,088,176 B2
(45) Date of Patent: Oct. 2, 2018

(54) AIR-CONDITIONING DEVICE

(71) Applicant: Mitsubishi Electric Corporation, Tokyo (JP)

(72) Inventors: Takashi Ikeda, Tokyo (JP); Mitsuhiro Shirota, Tokyo (JP); Takahiro Shishido, Tokyo (JP); Koichi Umetsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 27 days.

(21) Appl. No.: 15/504,839

(22) PCT Filed: Oct. 30, 2014

(86) PCT No.: PCT/JP2014/078891
§ 371 (c)(1),
(2) Date: Feb. 17, 2017

(87) PCT Pub. No.: WO2016/067408
PCT Pub. Date: May 6, 2016

(65) Prior Publication Data

US 2017/0276379 A1 Sep. 28, 2017

(51) Int. Cl.
*F24F 1/00* (2011.01)

(52) U.S. Cl.
CPC ..... *F24F 1/0011* (2013.01); *F24F 1/00* (2013.01); *F24F 2001/0048* (2013.01)

(58) Field of Classification Search
CPC ... F24F 1/0011; F24F 1/0018; F24F 2001/048
See application file for complete search history.

(56) References Cited

U.S. PATENT DOCUMENTS 5,573,059 A * 11/1996 Hamamoto ..... F24F 1/0007 165/122
7,163,374 B2 * 1/2007 Lee ..... F04D 29/281 416/186 R (Continued)

FOREIGN PATENT DOCUMENTS

EP 2469194 A1 6/2012
JP 03-013028 U1 2/1991

(Continued)

OTHER PUBLICATIONS

International Search Report of the International Searching Authority dated Jan. 27, 2015 for the corresponding International application No. PCT/JP2014/078891 (and English translation).

(Continued)

*Primary Examiner* — Cassey D Bauer
(74) *Attorney, Agent, or Firm* — Posz Law Group, PLC

(57) ABSTRACT

In an air-conditioning device, back flow is less likely to occur at an outlet port in relation to an inlet resistance, and the air-conditioning device includes: a main body having an inlet port and an outlet port; a cross-flow fan provided inside the main body; and a heat exchanger provided inside the main body, wherein the main body includes at least a front surface, a rear surface, an upper surface and a lower surface, the inlet port is formed in the upper surface, a ratio H/Df between the main body height dimension H and the fan outer diameter Df is 2.2 to 2.7, and an angle of inclination β between a rear part of an front upward inclination section of the heat exchanger and a vertical direction is 30° to 45°.

7 Claims, 5 Drawing Sheets

(56) References Cited

U.S. PATENT DOCUMENTS

| | | | | |
|---|---|---|---|---|
| 8,109,731 | B2 * | 2/2012 | Keber | F04D 29/023<br>416/186 R |
| 2002/0172588 | A1 * | 11/2002 | Ikeda | F04D 17/04<br>415/53.1 |
| 2005/0257561 | A1 * | 11/2005 | Lee | F04D 33/00<br>62/419 |
| 2010/0126206 | A1 * | 5/2010 | Park | F24F 1/0007<br>62/419 |
| 2014/0345835 | A1 * | 11/2014 | Hwang | F25D 17/06<br>165/121 |

FOREIGN PATENT DOCUMENTS

| | | | |
|---|---|---|---|
| JP | 05-099454 | A | 4/1993 |
| JP | 07-190476 | A | 7/1995 |
| JP | 07-260181 | A | 10/1995 |
| JP | H11-101461 | A | 4/1999 |
| JP | 2000-161765 | A | 6/2000 |
| JP | 2001-201077 | A | 7/2001 |
| JP | 2002-286244 | A | 10/2002 |
| JP | 2003-202119 | A | 7/2003 |
| JP | 2004-170034 | A | 6/2004 |
| JP | 2007-024419 | A | 2/2007 |
| JP | 2011-064360 | A | 3/2011 |
| JP | 2012-073024 | A | 4/2012 |
| WO | 02/029331 | A1 | 4/2002 |

OTHER PUBLICATIONS

Extended European Search Report dated Jul. 30, 2018 issued in corresponding EP patent application No. 14905254.0.

* cited by examiner

FIG. 4
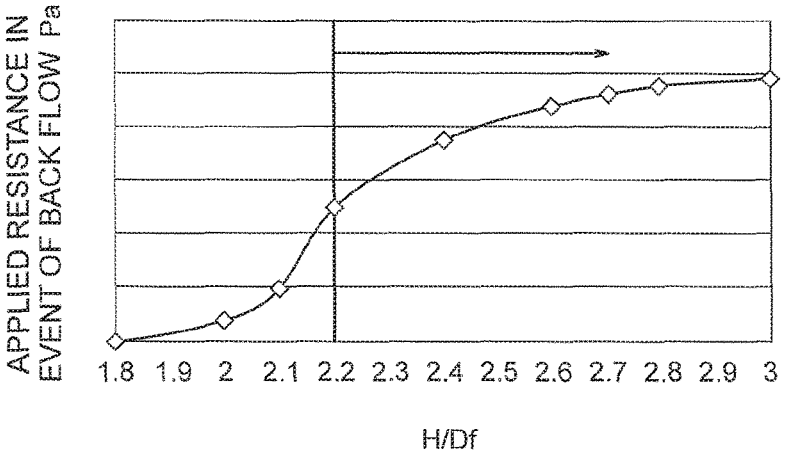
FIG. 5
| V | β | | | | | | |
|---|---|---|---|---|---|---|---|
| | 28 | 30 | 35 | 40 | 45 | 47 | 50 |
| 0.5 | ○ | ○ | ○ | ○ | ○ | ○ | × |
| 1.0 | ○ | ○ | ○ | ○ | ○ | ○ | × |
| 1.5 | ○ | ○ | ○ | ○ | ○ | × | × |
| 2.0 | ○ | ○ | ○ | ○ | ○ | × | × |
○:NO DRIPPING
×:DRIPPING
FIG. 6
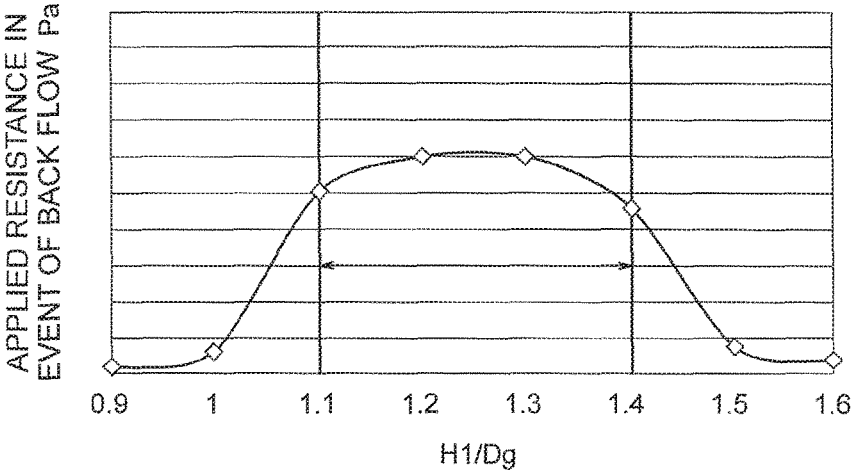

AIR-CONDITIONING DEVICE

CROSS REFERENCE TO RELATED APPLICATION

This application is a U.S. national stage application of PCT/JP2014/078891 filed on Oct. 30, 2014, the disclosure of which is incorporated herein by reference.

TECHNICAL FIELD

The present invention relates to an air-conditioning device.

BACKGROUND ART

The air-conditioning device disclosed in PTL 1 has a heat exchanger and a blower fan provided inside a main body. The heat exchanger has a rearward inclined section disposed in the rear part of the main body, and a downward inclined section that is inclined downwards so to fold back from the upper end of the rearward inclined section. The main body of the air-conditioning device is formed in a thin shape having a depth dimension that is greater than the height dimension.

Furthermore, in the air-conditioning device disclosed in PTL 2, an upper surface section of a main body is a flat surface that is substantially parallel with a ceiling surface, a bottom surface section of the main body rises up from a rear surface side towards a front surface side, and a main body is formed in a thin shape having a depth dimension that is greater than the height dimension.

CITATION LIST

Patent Literature

[PTL 1] Japanese Patent Application Laid-Open No. 2001-201077

[PTL 2] Japanese Patent Application Laid-Open No. H5-99454

SUMMARY OF THE INVENTION

Problem to Be Solved by the Invention

If the main body of the air-conditioning device is formed in a thin shape of which the depth dimension is greater than the height dimension, as described above, then a merit is obtained in that no sense of incongruity is produced in the indoor interior and the installation surface area on a wall surface can be suppressed.

On the other hand, by adopting a thin shape in the height direction, there are the following problems.

Firstly, in the air-conditioning device of PTL 1 described above, the heat exchanger and fan are in close proximity on the fan inlet side, the fan inlet region is small, and the air is not readily taken in in a uniform manner. Therefore, if the fan output flow is instable, and the air flow resistance has increased due to the adherence of dust, etc. to the filter, or if the air flow resistance on the fan inlet side has increased due to the generation of condensed water in the heat exchanger during cooling, then there is a problem in that back flow of air occurs from the main body outlet port towards the fan, and there is a risk of condensation occurring on the fan and being scattered into the room, especially during cooling.

Furthermore, in the air-conditioning device according to PTL 2 described above, since the distance between the main body outlet port and the outer periphery of the fan is small on the fan outlet side, then as described above, there is a problem in that the fan blow output flow becomes instable and back flow occurs when the flow resistance has increased, and there is a risk of condensation occurring on the fan and being scattered into the room, especially during cooling.

The present invention was devised in view of the foregoing, an object thereof being to provide an air-conditioning device wherein back flow at the outlet port is not liable to occur in relation to the inlet resistance.

Means for Solving the Problem

In order to achieve the object described above, the air-conditioning device according to the present invention is provided with: a main body having an inlet port and an outlet port; a cross-flow fan provided inside the main body; and a heat exchanger provided in the main body, wherein the main body includes a front surface, a rear surface, an upper surface and a lower surface, the inlet port is formed in the upper surface, a ratio H/Df between the main body height dimension H and the fan outer diameter Df is 2.2 to 2.7, and the angle of inclination β between a rear part of an front upward inclination section of the heat exchanger and a vertical direction is 30° to 45°.

Advantageous Effects of the Invention

According to the present invention, it is possible to provide an air-conditioning device wherein back flow is not liable to occur at the outlet port in relation to the inlet resistance.

BRIEF DESCRIPTION OF THE DRAWINGS

FIG. 4 is a graph showing a relationship between a ratio H/Df between the main body height dimension H and the fan outer diameter Df, and an applied resistance in the event of back flow.

FIG. 5 is a table showing a relationship between an angle of inclination β of a heat exchanger and the occurrence of drips of condensation.

FIG. 6 is a graph illustrating the relationship between a ratio H1/Dg between the minimum height H1 and the front/rear distance Dg, and the applied resistance on the inlet side in the event of back flow.

DESCRIPTION OF EMBODIMENTS

Figure 1:
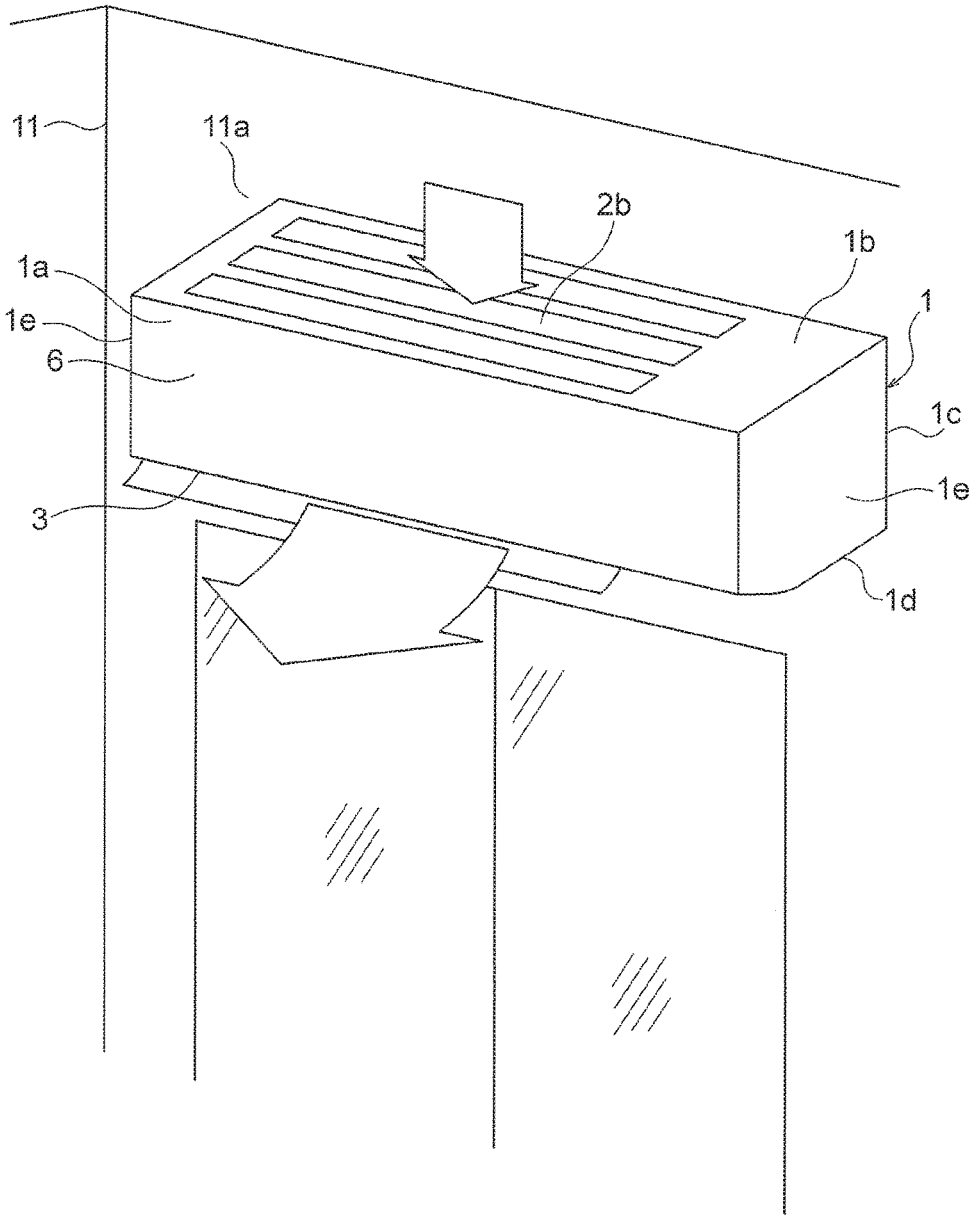
FIG. 1 is a diagram showing a state of installation of an air-conditioning device indicating a first embodiment of the present invention as viewed from inside a room.

Below, embodiments of an air-conditioning device (indoor unit) according to the present invention are described with reference to the drawings. Sections which are the same or corresponding below are labelled with the same reference numerals. Furthermore, an existing unit can be used for the outdoor unit.

First Embodiment

Figure 2:
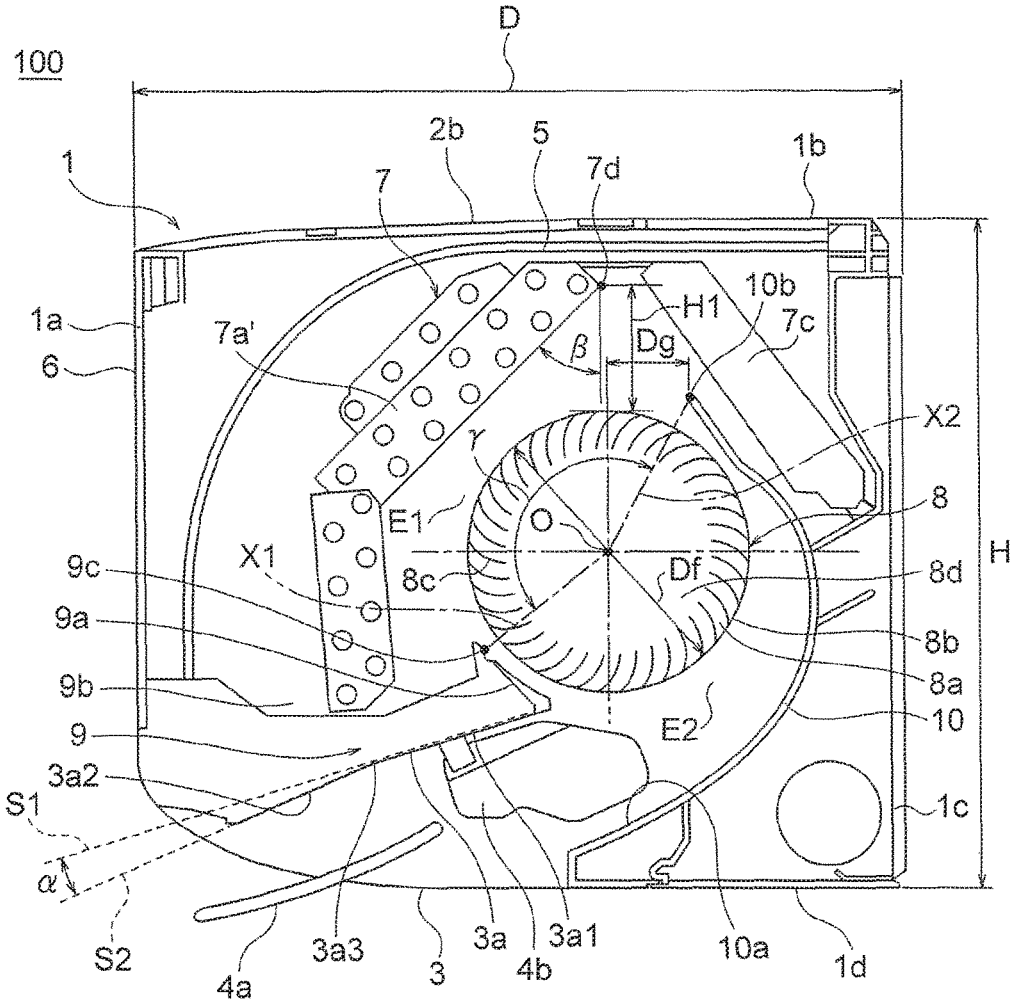
FIG. 2 is a diagram illustrating a lateral side view of an internal structure of the air-conditioning device according to the first embodiment.

FIG. 1 is a schematic installation diagram of an air-conditioning device according to a first embodiment of the present invention as viewed from the room. FIG. 2 is a diagram illustrating a lateral side view of an internal structure of the air-conditioning device according to the first embodiment. FIG. 2 shows a state during a horizontal blowing operation (lateral blowing operation) of the air-conditioning device.

As illustrated in FIG. 1, the air-conditioning device (indoor unit) 100 is provided with a main body 1 forming a case. The air-conditioning device 100 is a wall-mounted example, and is supported on a wall 11*a* of a room 11, which is a space to be air-conditioned. The air-conditioning device of the present invention is not limited to being installed in a room of a general dwelling, and may also be installed in a room or storage space of a facility building.

Furthermore, the air-conditioning device according to the present invention is an air-conditioning device which is not a so-called ceiling embedded-type device, but rather the rear surface of the main body abuts against or is in close proximity to a wall surface demarcating the space that is to be air-conditioned (a wall apart from the ceiling or floor), and the front surface of the main body faces the side of the space to be air-conditioned. In other words, in the air-conditioning device according to the present invention, the inlet port and the outlet port are not provided on the same surface, as in a ceiling embedded-type device, and are disposed alongside a wall surface that demarcates the space to be air-conditioned, away from the central portion of the space to be air-conditioned.

The main body 1 is, in general terms, a cuboid-shaped casing. More specifically, the main body 1 includes a rear surface 1*c* that opposes a wall 11*a* of the room 11, a front surface 1*a* which is on the opposite side to the rear surface 1*c*, an upper surface 1*b*, a lower surface 1*d*, and a left and right-hand pair of side surfaces 1*e*.

A grille-shaped inlet port 2*b* for taking indoor air into the air-conditioning device 100 is formed in the upper surface 1*b* of the main body 1. In the air-conditioning device 100, the inlet port is only provided on the upper surface 1*b* of the main body 1. An outlet port 3 for supplying conditioned air to the room is formed in a front part of the lower surface 1*d* of the main body 1. A front surface grille 6 is attached to the front surface 1*a* of the main body 1.

A cross-flow fan 8 having an impeller 8*a*, and a guide wall 10, is disposed inside the main body 1. The cross-flow fan 8 is disposed between the inlet-side flow channel (fan inlet-side region) E1 and the outlet-side flow channel (fan outlet-side region) E2, and air is taken in from the inlet port 2*b* and air is blown out to the outlet port 3. The guide wall 10 extends downwards from the rear of the cross-flow fan 8, and guides the air radiating from the cross-flow fan 8 to the outlet port 3.

The impeller 8*a* of the cross-flow fan 8 is configured by coupling together a plurality of impeller unit bodies 8*d*, which are described hereinafter. The impeller unit bodies 8*d* include a plurality blades 8*c* and a ring 8*b* which is fixed to the end portions of the blades 8*c*. More specifically, the impeller 8*a* is formed by coupling and integrating, by welding, a plurality of impeller unit bodies 8*d*, each of which is composed by a plurality of blades 8*c* extending in a substantially perpendicular direction from an outer peripheral side surface of a circular disk-shaped ring 8*b*, the blades 8*c* being disposed continuously at prescribed intervals apart in the circumferential direction of the ring 8*b*.

Moreover, a filter (air flow resistance body) 5 which removes dust, etc. from the air taken into via the inlet port 2*b*, a heat exchanger (air flow resistance body) 7 which generates conditioned air by transmitting the heating energy or cooling energy of a refrigerant to the air, and a stabilizer 9 which demarcates an inlet-side flow channel E1 and an outlet-side flow channel E2, are disposed inside the main body 1.

The guide wall 10 configures an outlet-side flow channel E2, in conjunction with a diffuser 3*a* which is formed on the lower surface of the stabilizer 9. In other words, the front surface 1*a* side of the main body 1 in the outlet-side flow channel is demarcated by the diffuser 3*a*, the rear surface 1*c* side of the main body 1 in the outlet-side flow channel is demarcated by the guide wall 10, and the outlet-side flow channel is configured by the diffuser 3*a* and the guide wall 10 which are mutually opposing. The guide wall 10 forms a vortex surface from the cross-flow fan 8 to the outlet port 3.

The filter 5 is formed in a mesh-shape, for instance, and removes dust, etc. in the air that is taken in via the inlet port 2*b*. The filter 5 is provided on the upstream side of the heat exchanger 7, and to the downstream side of the inlet port 2*b*, in the flow channel from the inlet port 2*b* to the outlet port 3. Furthermore, the filter 5 extends from the top to the front of the heat exchanger 7.

The heat exchanger 7 (indoor heat exchanger) functions as an evaporator and cools the air during a cooling operation, and functions as a condenser (heat radiator) and heats the air during a heating operation. This heat exchanger 7 is provided to the downstream side of the filter 5 and to the upstream side of the cross-flow fan 8 in the flow channel from the inlet port 2*b* to the outlet port 3 (the central portion of the interior of the main body 1).

The heat exchanger 7 has a shape that surrounds the front part and upper part of the cross-flow fan 8. The heat exchanger 7 includes a heat exchanger front part 7*a*. The heat exchanger front part 7*a* extends over the front and upper part of the cross-flow fan 8. Furthermore, the heat exchanger front part 7*a* includes a front upward inclination section 7*a*', the lower part of which is inclined to be positioned further forward (so as to approach the front surface 1*a*).

A sealing member 7*c* which functions as a partition wall is provided at the rear of the cross-flow fan 8 and at the rear of the guide wall 10. The sealing member 7*c* extends from the upper end of the heat exchanger front part 7*a* towards the rear surface side of the guide wall 10. For example, the sealing member 7*c* is configured by a box-shaped member that constitutes the outer profile shape of the heat exchanger.

The heat exchanger 7 is connected to an outdoor unit, which may adopt a well-known mode including a compressor, an outer heat exchanger, and a restrictor device, etc., thereby forming a cooling cycle. Furthermore, a cross-fin type fin-and-tube heat exchanger, which is constituted by a heat conduction pipe and a plurality of fins, for example, is used in the heat exchanger 7.

A vertical air flow direction vane 4*a* and a lateral air flow direction vane 4*b* are provided in the outlet-side flow channel. The lateral air flow direction vane 4*b* is provided rotatably between the vertical air flow direction vane 4*a* and the cross-flow fan 8. The vertical air flow direction vane 4*a* adjusts the vertical direction of the air flow blown out from the cross-flow fan 8, and the lateral air flow direction vane 4*b* adjusts the lateral direction of the air flow blown out from the cross-flow fan 8. The vertical air flow direction vane 4*a* and the lateral air flow direction vane 4*b* are driven to rotation in mutually independent fashion.

The vertical air flow direction vane 4*a* has a projecting shape in which the upper surface and the lower surface of the vertical air flow direction vane 4*a* both project downwards when viewed in the attitude thereof during a horizontal blowing operation.

The stabilizer 9 demarcates the inlet-side flow channel E1 and the outlet-side flow channel E2, in the manner described above, and is provided on the lower side of the heat exchanger 7 as illustrated in FIG. 2. The inlet-side flow channel E1 is positioned above the stabilizer 9, and the outlet-side flow channel E2 is positioned below the stabilizer 9.

The stabilizer 9 includes a tongue section 9*a*, a drain pan 9*b* which temporarily accumulates water droplets that drip down from the heat exchanger 7, and a diffuser 3*a*. The tongue section 9*a* is positioned at the front end portion of the stabilizer 9 and faces the cross-flow fan 8. The diffuser 3*a* is formed on the lower surface of the stabilizer 9, as described above, and functions as an upper wall surface (front surface-side wall surface) of the outlet-side flow channel of the outlet port 3.

As illustrated in FIG. 2, the upstream section 3*a*1 of the diffuser 3*a* extends in the same direction as the direction of extension of the downstream section 10*a* of the guide wall 10, and the upstream section 3*a*1 of the diffuser 3*a* is aligned substantially in parallel with the downstream section 10*a* of the guide wall 10, when viewed from the side. The upstream section 3*a*1 of the diffuser 3*a* opposes the downstream section 10*a* of the guide wall 10.

Furthermore, the upstream section 3*a*1 of the diffuser 3*a* has a linear portion when viewed from the side. When the direction of extension of the linear portion of the upstream section 3*a*1 of the diffuser 3*a*, as viewed from the lateral side as illustrated in FIG. 2, is the upstream section virtual straight line S1, then the downstream section 3*a*2 of the diffuser 3*a* extends so as to separate to the lower side from the upstream section virtual straight line S1, towards the downstream side of the downstream section 3*a*2. In other words, the diffuser 3*a* has a portion which, in lateral side view, separates from the upstream section virtual straight line S1, which is the direction of extension of the upstream section 3*a*1 of the diffuser 3*a*, towards the downstream side of the diffuser 3*a*. In particular, in the example illustrated in FIG. 2, the diffuser 3*a* is configured so as not to include a portion that is disposed above the upstream section virtual straight line S1 of the upstream section 3*a*1 of the diffuser 3*a*.

Furthermore, the downstream section 3*a*2 of the diffuser 3*a* has a linear portion when viewed from the side. When the direction of extension of the linear portion of the downstream section 3*a*2 of the diffuser 3*a* is the downstream section virtual straight line S2, then the downstream section virtual straight line S2 is situated below the upstream section virtual straight line S1. The diffuser 3*a* is curved or bent in the portion 3*a*3 which is positioned between the upstream section 3*a*1 and the downstream section 3*a*2 of the diffuser 3*a*.

In the first embodiment, the depth dimension D of the main body is greater than the main body height dimension H. The depth dimension D of the main body is the maximum value of the interval between the front surface 1*a* and the rear surface 1*c* of the main body 1, and the main body height dimension H is the maximum value of the interval between the upper surface 1*b* and the lower surface 1*d* of the main body 1. Furthermore, the ratio H/Df between the main body height dimension H and the fan outer diameter Df=2.2 to 2.7. Moreover, the angle of inclination β between the rear part of the front upward inclination section 7*a*' of the heat exchanger front part 7*a* of the heat exchanger 7, and the vertical direction, is 30° to 45°. This angle of inclination β is an angle which broadens in the forward and downward directions, with respect to the point of intersection of a line indicating the vertical direction and the rear part of the front upward inclination section 7*a*' (in the example in FIG. 2, the upper end 7*d* of the heat exchanger front part 7*a*), when viewed from the side. Furthermore, in the illustrated example, the majority of the front surface 1*a* of the main body 1 and the majority of the rear surface 1*c* thereof extend in a substantially vertical direction. The fan outer diameter Df indicates the outermost diameter of the impeller, and in the present embodiment, indicates the outer diameter of the ring 8*b*, but a similar effect is obtained if the diameter of a contiguous circle contacting the outer periphery of the blades 8*c* is within the prescribed numerical range.

By adopting a configuration of this kind, actions of the following kind are obtained. Firstly, if the outer diameter of the fan is too large, then the fan and the heat exchanger are too close to each other on the fan inlet side, the air flow after passing through the heat exchanger cannot readily reach the upstream end of the guide wall, and furthermore, due to the short distance between the outlet port and the fan on the fan outlet side, a low-speed region occurs on the side of the guide wall and there is a risk of back flow from the outlet port. Furthermore, since the air flows in with an uneven distribution, then the loss increases and the power consumption of the motor increases. On the other hand, if the outer diameter of the fan is too small, then it is necessary to raise the rotational speed in order to obtain the required air flow volume, and therefore the output consumption of the motor increases and energy efficiency is poor.

On the other hand, in the first embodiment, since the depth dimension of the main body is greater than the height dimension of the main body, then the main body is thin in the height direction, the distance between the upper surface 1*b* of the main body 1 and the ceiling surface (not illustrated) and the distance between the lower surface 1*d* of the main body 1 and the curtain rail (not illustrated) is increased, and it is possible to suppress increase in the resistance to the air flow when installed. Furthermore, even if the heat exchanger, which has received a hydrophilic treatment, loses hydrophilic properties due to the effects of water-repellent materials in the room, the condensed water generated by the heat exchanger does not drip down onto the fan. Moreover, high-density installation of the heat exchanger is possible, the heat exchange volume can be increased, and high performance can be achieved.

Figure 3:
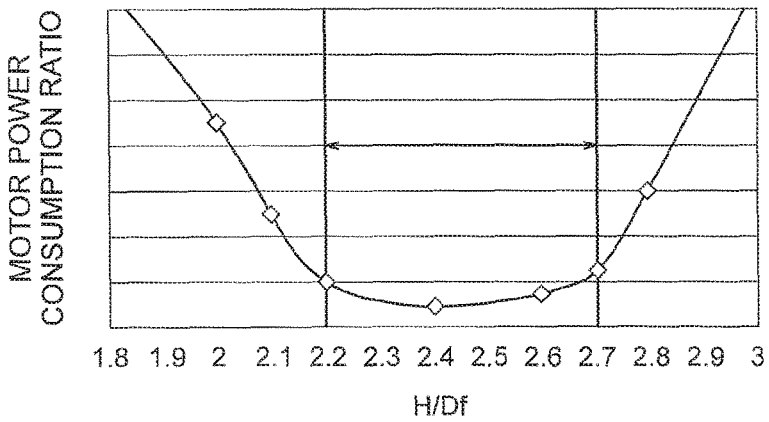
FIG. 3 is a graph showing a relationship between a ratio H/Df between the main body height dimension H and the fan outer diameter Df, and a motor power consumption ratio.

FIG. 3 shows the relationship between the ratio of motor power consumption and the ratio H/Df between the main body height dimension H and fan outer diameter Df, and it can be seen that if H/Df is equal to or greater than 2.2 and equal to or less than 2.7, then at least a stable effect with little variation in performance can be obtained.

Furthermore, FIG. 4 is a graph illustrating the relationship between the ratio H/Df between the main body height dimension H and the fan outer diameter Df, and the applied resistance in the event of back flow, and it can be seen that if H/Df is equal to or greater than 2.2, then at least back flow is not liable to occur, even if a resistance is applied.

Furthermore, FIG. 5 is a table illustrating the relationship between the angle of inclination β of the heat exchanger and the occurrence of dripping of condensation, and indicates the state of occurrence of drips when the front surface air flow velocity V of the heat exchanger is changed while water droplets are supplied thereto (V=0.5 [m/s], 1.0 [m/s], 1.5 [m/s], 2.0 [m/s]).

From the foregoing, provided that at least H/Df=2.2 to 2.7 and β=30° to 45°, back flow at the outlet port is not liable to occur in relation to the inlet resistance, and an air-conditioning device having high quality and good energy efficiency can be obtained.

Furthermore, in the first embodiment, the upper end (rear end) 7*d* of the heat exchanger front part 7*a* is situated at a position further toward the front side than the rotation centre O of the fan, in other words, at a position closer to the front surface 1*a* of the main body 1 than the rotation centre O of the fan in a front/rear direction. Moreover, when the height difference from the upper end 7*d* of the heat exchanger front part 7*a* to the outer circumference end of the fan (the uppermost part of the rotational trajectory of the outer circumference end of the fan) is the minimum height H1, and the front/rear distance (horizontal distance) from the upper end 7*d* of the heat exchanger front part 7*a* to the guide wall start end (uppermost part) 10*b* is the front/rear distance Dg, then the ratio H1/Dg between the minimum height H1 and the front/rear distance Dg is 1.1 to 1.4.

By adopting a configuration of this kind, actions of the following kind are obtained. Firstly, if the upper end of the heat exchanger front part is positioned further toward the front side than the rotation centre of the fan, then there is a problem in that the air flow cannot readily reach the guide wall. Furthermore, if the minimum height H1 is too large in relation to Dg, then in a configuration where there is no heat exchanger on the rear side of the cross-flow fan (as illustrated in FIG. 2, for example, there is no heat exchanger at the position indicated by the sealing member 7*c*), then the flow becomes instable on the guide wall side in the fan inlet-side region E1, and ceases to flow to the guide wall surface in the fan outlet-side region E2, and therefore if there is increased air flow resistance due to the accumulation of dust in the filter or if there is increased air flow resistance due to the adherence of condensed water to the heat exchanger during cooling, then there is a risk of back flow occurring from the outer part of the main body. Therefore, the quality declines.

On the other hand, in the first embodiment, the upper end 7*d* of the heat exchanger front part 7*a* and the start end 10*b* of the guide wall are provided so as to satisfy the conditions described above, and therefore a stable flow of air is also obtained in the guide wall side region of the fan inlet-side region, the abovementioned problems do not occur and an air-conditioning device of high quality can be achieved.

FIG. 6 is a graph illustrating the relationship between the ratio H1/Dg between the minimum height H1 and the front/rear distance Dg, and the applied resistance on the inlet side in the event of back flow. If the minimum height H1 is too great compared to the front/rear distance Dg, then the height of the main body above the fan becomes greater, and it becomes difficult to achieve a thin main body. Furthermore, if the main body height is the same, then the height on the fan outlet side cannot be guaranteed, the flow becomes instable, and back flow occurs even if the applied resistance is low. On the other hand, provided that at least H1/Dg is 1.1 to 1.4, then the flow is stable and an air-conditioning device of high quality is obtained.

Furthermore, in the first embodiment, the ratio H1/Df between the minimum height H1 and the fan outer diameter Df is 0.5 to 0.7.

By adopting a configuration of this kind, actions of the following kind are obtained. Firstly, if the minimum height is too small with respect to the outer diameter of the fan, the flow from the upper end of the heat exchanger front part cannot readily reach the guide wall, and in particular in a configuration where there is no heat exchanger on the rear side of the cross-flow fan, the flow becomes instable in the guide wall-side region of the fan inlet-side region, and the air ceases to flow to the guide wall surface of the fan inlet-side region. Therefore, if the air flow resistance is increased due to the accumulation of dust in the filter, or if the air flow resistance is increased due to the adherence of condensed water in the heat exchanger during heating, there is a risk of back flow occurring in the outer part of the main body. Therefore, the quality of the air-conditioning device declines.

Figure 7:
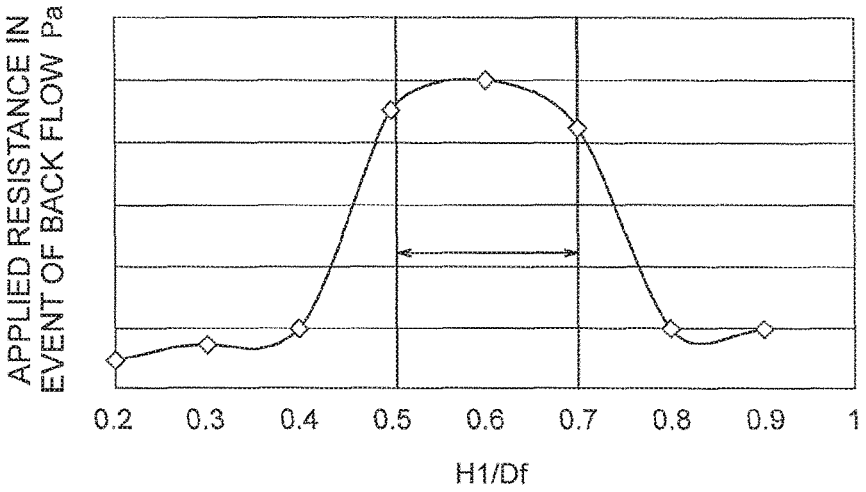
FIG. 7 is a graph illustrating the relationship between a ratio H1/Df between the minimum height H1 and the fan outer diameter Df, and the applied resistance on the inlet side in the event of back flow.

On the other hand, in the first embodiment, since the ratio H1/Df between the minimum height H1 and the fan outer diameter Df is 0.5 to 0.7, then the behaviour of the air flow is not liable to become worse even if an air flow resistance is applied, and the quality of the air-conditioning device can be guaranteed. FIG. 7 is a graph illustrating the relationship between the ratio H1/Df between the minimum height H1 and the fan outer diameter Df, and the applied resistance on the inlet side in the event of back flow. If the minimum height H1 is too large with respect to the fan outer diameter Df, then the height of the main body above the fan becomes greater, and in the case of the same main body height, it is not possible to ensure height on the fan outlet side, the flow becomes instable, and back flow occurs even if the applied resistance is low. On the other hand, provided that at least the ratio H1/Df between the minimum height H1 and the fan outer diameter Df is 0.5 to 0.7, then the behaviour of the flow is not liable to become worse, even if an air flow resistance is applied.

Furthermore, in the first embodiment, when the position where the distance between the cross-flow fan 8 and the tongue section 9*a* of the stabilizer 9 is smallest, viewed from the lateral side, is the minimum gap position 9*c* of the tongue section 9*a*, the virtual straight line linking the minimum gap position 9*c* and the rotation centre O of the fan is a straight line X1, the virtual straight line linking the rotation centre O of the fan and the guide wall start end 10*b* is a straight line X2, and the angle occurring in the fan inlet-side region E1, of the angle formed between the straight line X1 and the straight line X2, is the fan inlet angle γ, then this fan inlet angle γ is 150° to 180°. Moreover, the outlet port 3 is open in the front part of the lower surface 1*d* of the main body 1, and the diffuser 3*a* has a portion which, in lateral side view, separates from the upstream section virtual straight line S1, which is the direction of extension of the upstream section 3*a*1 of the diffuser 3*a*, towards the downstream side of the diffuser 3*a*.

Figure 8:
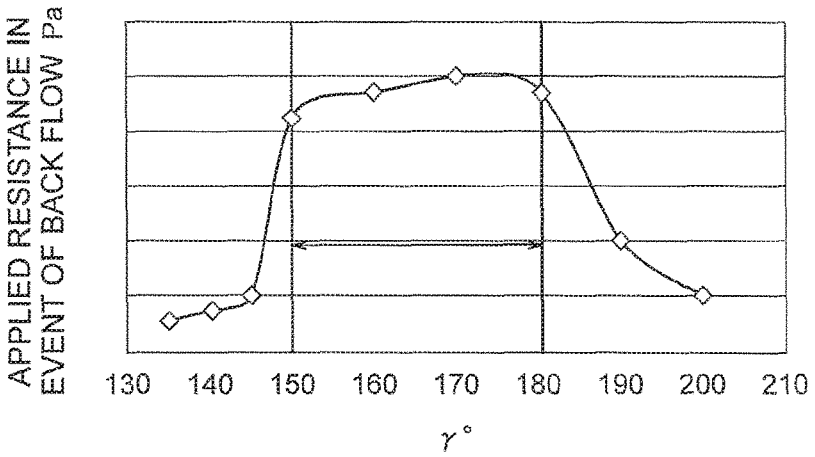
FIG. 8 is a graph showing a relationship between a fan inlet angle γ and an applied resistance on the inlet side in the event of back flow.

By adopting a configuration of this kind, following actions can be obtained. Noise from the fan which is reflected at the guide wall is reflected towards the lower part of the main body by the wall surface of the diffuser to the downstream side of the fan, thereby suppressing the radiation of noise to the front surface side of the air-conditioning device and achieving silent operation. Furthermore, since the wall surface flow accelerates in the downstream portion of the diffuser, then it is possible to inhibit back flow from the inlet port to the fan that occurs due to increase in the air flow resistance caused by accumulation of dust in the filter provided on the inlet side, and therefore hot air of high humidity does not flow back inside the air-conditioning device during cooling, not resulting in causing condensation, and therefore quality is improved. Moreover, if the fan inlet angle γ is too large, then the inlet range becomes too large, the flow is biased towards the side of the circulating vortex, which is a characteristic feature of cross-flow fans and which forms on the tongue section side of the interior of the impeller, and the flow cannot readily reach the guide wall and becomes instable, whereas in the first embodiment, as illustrated in FIG. 8, it can be seen that the flow is made stable by setting the fan inlet angle γ to 150° to 180°.

Figure 9:
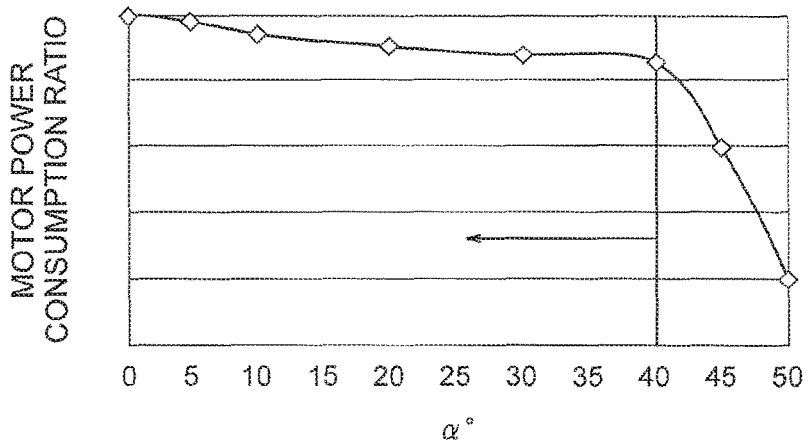
FIG. 9 is a graph showing a relationship between an angle α and a motor power consumption.
Figure 10:
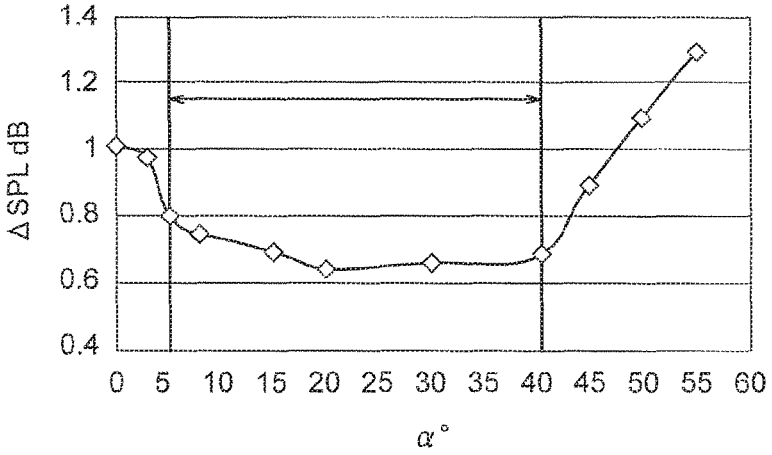
FIG. 10 is a graph showing change, with the angle α, of a noise differential with respect to a state where the angle α=0°.
Figure 11:
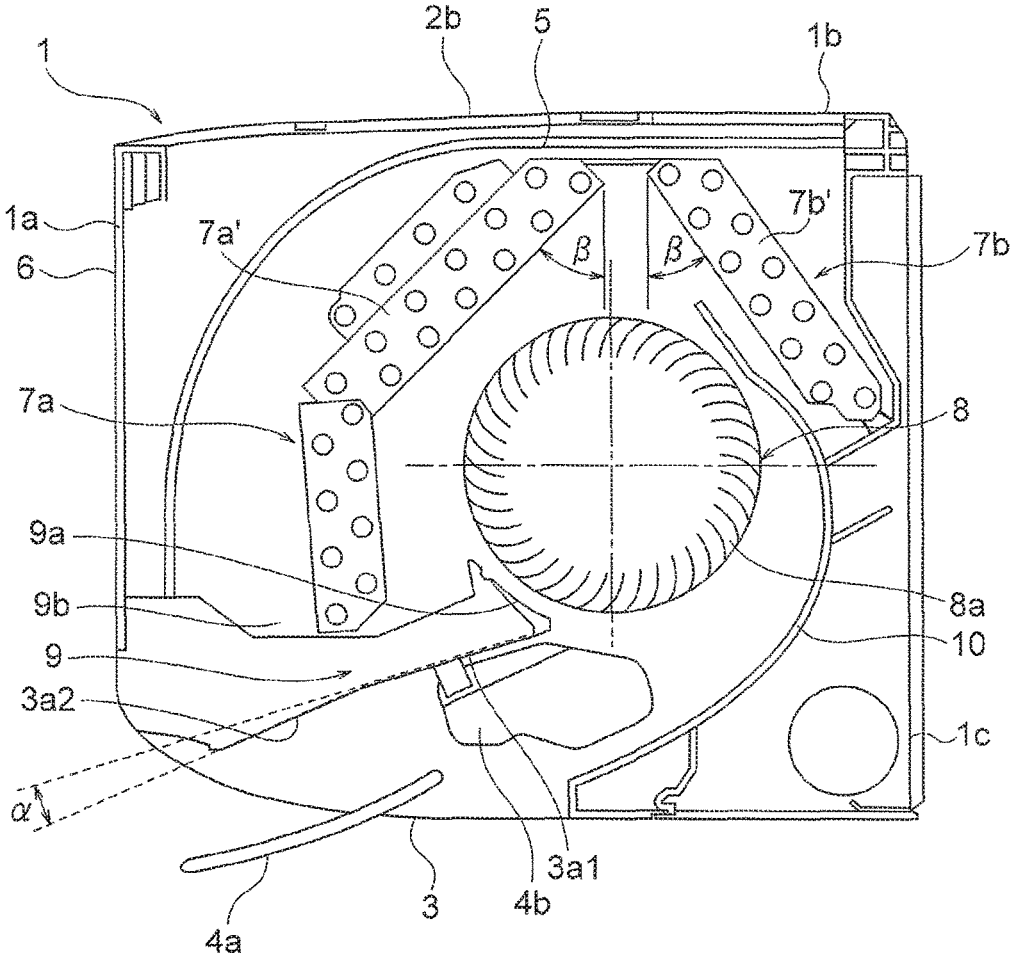
FIG. 11 is a diagram of the same mode as FIG. 2, showing specifications wherein a heat exchanger front part and a heat exchanger rear part are arranged about the periphery of a cross-flow fan.

Furthermore, in the first embodiment, the angle α between the upstream section virtual straight line S1 and the downstream section virtual straight line S2 is desirably 5° to 40°. FIG. 9 is a graph illustrating the relationship between the angle α and the power consumption of the motor, and FIG. 10 is a graph illustrating change, with the angle α, in the noise differential with respect to a state where the angle α=0°. From FIG. 9, it can be seen that, at least, there is little worsening of the power consumption of the motor, provided that the angle α is no greater than 40°. Furthermore, it can also be seen that, at least, a noise suppressing effect is obtained if the angle α is 5° to 40°. In other words, since the noise from the fan that is reflected by the guide wall is reflected towards the lower part of the main body by the wall surface of the diffuser on the downstream side of the fan, thereby suppressing the radiation of noise to the front surface side of the air-conditioning device and achieving silent operation, and since the air flow resistance is not increased by the downstream part of the diffuser, then worsening of the power consumption of the motor is avoided, and it is possible to achieve both silent operation and energy efficiency.

Furthermore, one characteristic feature of the first embodiment is that it is possible to combine specifications wherein the heat exchanger front part 7*a* and the sealing member 7*c* are arranged about the periphery of the cross-flow fan 8, and specifications wherein the heat exchanger front part 7*a* and the heat exchanger rear part 7*b* are arranged about the periphery of the cross-flow fan 8.

The heat exchanger rear part 7*b* functions as one portion of the heat exchanger 7, similarly to the heat exchanger front part 7*a*. In other words, in specifications where the heat exchanger front part 7*a* and the heat exchanger rear part 7*b* are disposed about the periphery of the cross-flow fan 8, the heat exchanger 7 is configured by the heat exchanger front part 7*a* and the heat exchanger rear part 7*b*, and the heat exchanger 7 has a shape which surrounds the front part, upper part and rear part of the cross-flow fan 8.

The heat exchanger rear part 7*b* extends over the upper part and rear part of the cross-flow fan 8. Furthermore, the heat exchanger rear part 7*b* includes a rear upward inclination section 7*b*', the lower part of which is inclined to be positioned further rearward (so as to approach the rear surface 1*c*).

Moreover, similarly to the case of the front upward inclination section 7*a*' described above, the rear upward inclination section 7*b*' has an angle of inclination β. In other words, the angle of inclination β between the vertical direction and the front part of the rear upward inclination section 7*b*' of the heat exchanger rear part 7*b* is the same as the angle of inclination β between the vertical direction and the rear part of the front upward inclination section 7*a*' of the heat exchanger front part 7*a*. To give a specific example, the angle of inclination β between the vertical direction and the front part of the rear upward inclination section 7*b*' of the heat exchanger rear part 7*b* and the angle of inclination β between the vertical direction and the rear part of the front upward inclination section 7*a*' of the heat exchanger front part 7*a* are both 30° to 45°.

By adopting a configuration of this kind, it is possible to meet the required heat exchanger capability in the main body, by modifying the capacity of the heat exchanger, while using the same air flow channels, and therefore it is possible to avoid excessive installation of heat exchangers, thus preventing waste of materials, saving resources and reducing the weight of the main body.

The contents of the present invention have been described above with reference to preferred embodiments, but it would be obvious to a person skilled in the art that various modifications can be made on the basis of the basic technical concepts and teachings of the present invention.

REFERENCE SIGNS LIST

1 Main body
1*a* Front surface
1*b* Upper surface
1*c* Rear surface
1*d* Lower surface
1*c* Rear surface
2*b* Inlet port
3 Outlet port
3*a* Diffuser
3*a*1 Upstream part of diffuser
3*a*2 Downstream part of diffuser
7 Heat exchanger
7*a* Heat exchanger front part
7*d* Upper end of heat exchanger front part
8 Cross-flow fan
9 Stabilizer
9*a* Tongue section
9*c* Minimum gap position
10 Guide wall
10*b* Guide wall start end
100 Air-conditioning device

The invention claimed is:

1. An air-conditioning device, comprising:

a main body having an inlet port and an outlet port;

a cross-flow fan provided inside the main body; and a heat exchanger provided inside the main body, wherein the main body includes a front surface, a rear surface, an upper surface and a lower surface, the inlet port is formed in the upper surface, a ratio H/Df between a height dimension H of the main body and an outer diameter Df of the fan is 2.2 to 2.7, an angle of inclination β between a rear part of a front upward inclination section of the heat exchanger, and a vertical direction, is 30° to 45°, and when the height difference between the upper end of the heat exchanger front part and the outer circumference end of the fan is the minimum height H1, then a ratio H1/Df between the minimum height H1 and the fan outer circumference Df is 0.5 to 0.7.

2. The air-conditioning device according to claim 1, wherein an upstream side of the outlet port is an outlet-side flow channel;

the rear surface side of the outlet-side flow channel is demarcated by a guide wall;

an upper end of a heat exchanger front part of the heat exchanger is arranged at a position further toward a front side than the rotation centre O of the fan; and when a height difference between the upper end of the heat exchanger front part and an outer circumference end of the fan is a minimum height H1, and a front/rear distance from the upper end of the heat exchanger front part to a start end of the guide wall is a front/rear distance Dg, then a ratio H1/Dg between the minimum height H1 and the front/rear distance Dg is 1.1 to 1.4.

3. The air-conditioning device according to claim 1, wherein an upstream side of the outlet port is an outlet-side flow channel, the rear surface side of the outlet-side flow channel is demarcated by the guide wall, a front end section of a stabilizer which demarcates an inlet-side flow channel and the outlet-side flow channel is a tongue section, when a position where a distance between the cross-flow fan and the tongue section is smallest, viewed from a lateral side, is a minimum gap position of the tongue section, a virtual straight line linking the minimum gap position and the rotation centre O of the fan is a straight line X1, a virtual straight line linking the rotation centre O of the fan and the start end of the guide wall is a straight line X2, and an angle occurring in the inlet-side flow channel, of an angle formed between the straight line X1 and the straight line X2, is a fan inlet angle γ, then the fan inlet angle γ is 150° to 180°, the front surface side of the outlet-side flow channel is demarcated by a diffuser, and the diffuser has a portion which separates from an upstream section virtual straight line S1, which is a direction of extension of an upstream section of the diffuser, towards a downstream side of the diffuser, in lateral side view.

4. The air-conditioning device according to claim 1, wherein the upstream side of the outlet port is an outlet-side flow channel, the front surface side of the outlet-side flow channel is demarcated by the diffuser; and when a direction of extension of a linear portion of the upstream section of the diffuser, in lateral side view, is an upstream section virtual straight line S1, and a direction of extension of a linear portion of a downstream section of the diffuser is a downstream section virtual straight line S2, then an angle α formed by the upstream section virtual straight line S1 and the downstream section virtual straight line S2 is 5° to 40°.

5. An air-conditioning device, comprising:

a main body having an inlet port and an outlet port;

a cross-flow fan provided inside the main body; and a heat exchanger provided inside the main body, wherein the main body includes a front surface, a rear surface, an upper surface and a lower surface, the inlet port is formed in the upper surface, a ratio H/Df between a height dimension H of the main body and an outer diameter Df of the fan is 2.2 to 2.7, an angle of inclination β between a rear part of a front upward inclination section of the heat exchanger, and a vertical direction, is 30° to 45°, an upstream side of the outlet port is an outlet-side flow channel;

the rear surface side of the outlet-side flow channel is demarcated by a guide wall;

an upper end of a heat exchanger front part of the heat exchanger is arranged at a position further toward a front side than the rotation centre O of the fan; and when a height difference between the upper end of the heat exchanger front part and an outer circumference end of the fan is a minimum height H1, and a front/rear distance from the upper end of the heat exchanger front part to a start end of the guide wall is a front/rear distance Dg, then a ratio H1/Dg between the minimum height H1 and the front/rear distance Dg is 1.1 to 1.4.

6. The air-conditioning device according to claim 5, wherein an upstream side of the outlet port is an outlet-side flow channel, the rear surface side of the outlet-side flow channel is demarcated by the guide wall, a front end section of a stabilizer which demarcates an inlet-side flow channel and the outlet-side flow channel is a tongue section, when a position where a distance between the cross-flow fan and the tongue section is smallest, viewed from a lateral side, is a minimum gap position of the tongue section, a virtual straight line linking the minimum gap position and the rotation centre O of the fan is a straight line X1, a virtual straight line linking the rotation centre O of the fan and the start end of the guide wall is a straight line X2, and an angle occurring in the inlet-side flow channel, of an angle formed between the straight line X1 and the straight line X2, is a fan inlet angle γ, then the fan inlet angle γ is 150° to 180°, the front surface side of the outlet-side flow channel is demarcated by a diffuser, and the diffuser has a portion which separates from an upstream section virtual straight line S1, which is a direction of extension of an upstream section of the diffuser, towards a downstream side of the diffuser, in lateral side view.

7. The air-conditioning device according to claim 5, wherein the upstream side of the outlet port is an outlet-side flow channel, the front surface side of the outlet-side flow channel is demarcated by the diffuser; and when a direction of extension of a linear portion of the upstream section of the diffuser, in lateral side view, is an upstream section virtual straight line S1, and a direction of extension of a linear portion of a downstream section of the diffuser is a downstream section virtual straight line S2, then an angle α formed by the upstream section virtual straight line S1 and the downstream section virtual straight line S2 is 5° to 40°.

* * * * *